US007133006B2

(12) United States Patent
Ide et al.

(10) Patent No.: US 7,133,006 B2
(45) Date of Patent: Nov. 7, 2006

(54) DISPLAY PANEL DRIVE APPARATUS

(75) Inventors: Shigeo Ide, Yamanashi (JP); Kenichi Kobayashi, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 555 days.

(21) Appl. No.: 10/135,771

(22) Filed: May 1, 2002

(65) Prior Publication Data

US 2002/0167381 A1 Nov. 14, 2002

(30) Foreign Application Priority Data

May 8, 2001 (JP) ..... 2001-137207

(51) Int. Cl.
*G09G 3/28* (2006.01)

(52) U.S. Cl. ..... 345/60; 315/169.1; 315/169.3

(58) Field of Classification Search ..... 345/37, 345/41, 42, 60–71, 72, 211, 213, 76–81, 690–693, 345/212, 101, 204; 315/169.1, 169.2, 169.4
See application file for complete search history.

(56) References Cited

U.S. PATENT DOCUMENTS 5,745,085 A * 4/1998 Tomio et al. ..... 345/63
5,828,353 A * 10/1998 Kishi et al. ..... 345/55
5,926,174 A * 7/1999 Shibamiya et al. ..... 345/213
6,057,815 A 5/2000 Sano
6,057,819 A * 5/2000 Sone et al. ..... 345/96
6,463,396 B1 * 10/2002 Nishigaki ..... 702/132
6,466,186 B1 * 10/2002 Shimizu et al. ..... 345/60
6,479,943 B1 * 11/2002 Shigeta et al. ..... 315/169.4
6,646,624 B1 * 11/2003 Masumori et al. ..... 345/60
2002/0005844 A1 * 1/2002 Kosaka et al. ..... 345/204
2002/0036606 A1 * 3/2002 Ichikawa et al. ..... 345/87

FOREIGN PATENT DOCUMENTS

EP 0680067 A 11/1995
EP 0896316 A 2/1999
JP 02029779 A * 1/1990
JP 05019714 A * 1/1993
JP 6-4039 1/1994
JP 10091117 A * 4/1998
JP 2002215087 A * 7/2002
JP 2002297093 A * 10/2002

OTHER PUBLICATIONS

JP 02029779 A, Yoshikawa et al., Method for Driving Plasma Display Panel and It's Circuit, Jan. 31, 1990, English Translation.*

* cited by examiner

*Primary Examiner*—Henry N. Tran
(74) *Attorney, Agent, or Firm*—Sughrue Mion, PLLC

(57) ABSTRACT

A drive apparatus for driving a display panel having a plurality of row electrode groups each of which includes a plurality of row electrodes, and a plurality of column electrodes arrayed in the direction intersecting with each row electrode of the plurality of row electrode groups to form display cells at the intersection points. The drive apparatus comprises a controller for generating a control signal for each of the row electrode groups, and a row electrode drive circuit for generating a drive pulse in response to the control signal and supplying the pulse to each row electrode of each of the row electrode groups. The control signal is delayed when being supplied to the drive circuit for each of the row electrode groups.

26 Claims, 9 Drawing Sheets

SUSTAINING PULSE

OUTPUT VOLTAGE
OF DRIVER $4_1$
DELAY INTERVAL
SUSTAINING PULSE

OUTPUT VOLTAGE
OF DRIVER $4_2$

OUTPUT CURRENT
OF DRIVER $4_1$

OUTPUT CURRENT
OF DRIVER $4_2$

DISPLAY PANEL DRIVE APPARATUS

BACKGROUND OF THE INVENTION

1. Field of the Invention

The present invention relates to a drive apparatus for a display panel such as a matrix display-type plasma display panel (PDP).

2. Description of the Related Background Art

It is well known that a PDP is a thin, flat display for which various kinds of research have been conducted, and that one kind of PDP is known as a matrix display-type PDP.

FIG. 1 shows a schematic configuration of a PDP drive apparatus having the PDP.

As shown in FIG. 1, a PDP 1 has row electrodes $Y_1$ to $Y_{nk}$ and row electrodes $X_1$ to $X_{nk}$ forming row electrode pairs such that each X and Y pair corresponds to each row (row 1 to row nk) of a single screen. The PDP 1 additionally comprises column electrodes $D_1$ to $D_m$ constituting column electrodes that correspond to each column (column 1 to column m) of a single screen. The column electrodes $D_1$ to $D_m$ are formed orthogonally to the row electrode pairs with dielectric layers and a discharge gap, which are not shown in the figure, interposed therebetween. A discharge cell that corresponds to a single pixel is formed at the intersection of one row electrode pair and one column electrode.

The row electrodes $X_1$ to $X_{nk}$ and row electrodes $Y_1$ to $Y_{nk}$ are each divided into n groups of k rows per group. Specifically, these groups are $X_1$ to $X_k$, $X_{k+1}$ to $X_{2k}$, . . . , $X_{(n-1)k+1}$ to $X_{nk}$ and $Y_1$ to $Y_k$, $Y_{k+1}$ to $Y_{2k}$, . . . , $Y_{(n-1)k+1}$ to $Y_{nk}$ These n groups correspond to X row electrode drivers $\mathbf{3}_1$ to $\mathbf{3}_n$ and Y row electrode drivers $\mathbf{4}_1$ to $\mathbf{4}_n$, respectively.

A address driver 2 converts pixel data of each pixel based on a video signal to a pixel data pulse having a voltage value corresponding to a logic level of the pixel data and applies the voltage to each of the column electrodes $D_1$ to $D_m$ for each row.

The X row electrode drivers $\mathbf{3}_1$ to $\mathbf{3}_n$, respectively, have sustaining, drivers $\mathbf{5}_1$ to $\mathbf{5}_n$ and output drivers $\mathbf{6}_1$ to $\mathbf{6}_n$. There is a line XL commonly connecting between sustaining drivers $\mathbf{5}_1$ to $\mathbf{5}_n$ and output drivers $\mathbf{6}_1$ to $\mathbf{6}_n$. Each of the sustaining drivers $\mathbf{5}_1$ to $\mathbf{5}_n$ generates, as a drive pulse, a reset pulse for initializing residual wall charge of each discharge cell and a sustaining discharge pulse for sustaining a discharge luminescence state of a luminescent discharge cell as described later, and applies these pulses to the row electrodes $X_1$ to $X_{nk}$ via the corresponding output driver $\mathbf{6}_1$ to $\mathbf{6}_n$.

The Y row electrode drivers $\mathbf{4}_1$ to $\mathbf{4}_n$, respectively, have sustaining drivers $\mathbf{7}_1$ to $\mathbf{7}_n$ and scan drivers $\mathbf{8}_1$ to $\mathbf{8}_n$. There is a line YL commonly connecting between the sustaining drivers $\mathbf{7}_1$ to $\mathbf{7}_n$ and the scan drivers $\mathbf{8}_1$ to $\mathbf{8}_n$. Each of the sustaining drivers $\mathbf{7}_1$ to $\mathbf{7}_n$, in a manner similar to the sustaining drivers $\mathbf{5}_1$ to $\mathbf{5}_n$ of the X row electrode drivers $\mathbf{3}_1$ to $\mathbf{3}_n$, generates a reset pulse for initializing residual wall charge of each discharge cell and a sustaining discharge pulse for sustaining a discharge luminescence state of each luminescent discharge cell, and applies these pulses on each of the row electrodes $Y_1$ to $Y_{nk}$ via the corresponding scan driver $\mathbf{8}_1$ to $\mathbf{8}_n$. Each of the scan drivers $\mathbf{8}_1$ to $\mathbf{8}_n$ generates a scan pulse SP for setting a luminescent discharge cell or non-luminescent discharge cell by obtaining the charge corresponding to the pixel data pulse for each discharge cell, and applies the pulse to the row electrodes $Y_1$ to $Y_{nk}$.

The connecting lines XL and YL are provided to unify the voltage levels of the drive pulses for the drivers $\mathbf{3}_1$ to $\mathbf{3}_n$, $\mathbf{4}_1$ to $\mathbf{4}_n$, respectively.

A control circuit 9 controls generation timing of the drive pulses of sustaining drivers $\mathbf{5}_1$ to $\mathbf{5}_n$, output drivers $\mathbf{6}_1$ to $\mathbf{6}_n$, the sustaining drivers $\mathbf{7}_1$ to $\mathbf{7}_n$, and the scan drivers $\mathbf{8}_1$ to $\mathbf{8}_n$.

FIG. 2 shows the configurations of the sustaining driver $\mathbf{7}_1$ and the scan driver $\mathbf{8}_1$. The sustaining driver $\mathbf{7}_1$ has power supplies B1, B2, a capacitor C, coils L1 to L2, a resistor R1, diodes D1, D2, and switching elements S1 to S6. The power supply B1 outputs a voltage $V_R$. The power supply B2 outputs a voltage $V_S$. The negative terminal of the power supply B1 is grounded, and the positive terminal is connected to the above-mentioned connecting line YL via the switching element S6 and the resistor R1.

The connecting line YL is grounded via the switching element S5 and the switching element S4. The voltage $V_S$ from the positive terminal of the power supply B2 is applied via the switching element S3 to a connecting line CL between the switching element S5 and the switching element S4. Between the connecting line CL and the ground, the switching element S1, the diode D1, the coil L1, and the capacitor C are connected in series sequentially from the connecting line CL side. The polarity of the diode D1 is such that the anode is the coil L1 side and the cathode is the switching element S1 side. The series circuit including the coil L2, diode D2, and switching element S2 is connected in parallel to the series portion including the switching element S1, diode D1, and coil L1. One end of the coil L2 is connected to the connecting line CL, and one end of the switching element S2 is connected to the capacitor C. The polarity of the diode D2 is such that the anode is the coil L2 side and the cathode is the switching element S2 side.

The scan driver $\mathbf{8}_1$ has a power supply B3, switching elements $S\mathbf{7}_1$ to $S\mathbf{7}_k$, $S\mathbf{8}_1$ to $S\mathbf{8}_k$, and diodes $D\mathbf{7}_1$ to $D\mathbf{7}_k$, $D\mathbf{8}_1$ to $D\mathbf{8}_k$. The power supply B3 outputs a voltage $V_h$. The positive terminal of the power supply B3 is connected to the connecting line YL, and the negative terminal is connected to a negative-side connecting line NL within the scan driver $\mathbf{8}_1$. Between the connecting line YL and the negative-side connecting line NL, the switching elements $S\mathbf{7}_1$ and $S\mathbf{8}_1$ are connected in series, and the diodes $D\mathbf{7}_1$ and $D\mathbf{8}_1$ are also connected in series. The polarities of the diodes $D\mathbf{7}_1$ and $D\mathbf{8}_1$ are such that the cathode of the diode $D\mathbf{7}_1$ is the connecting line YL side, the anode of the diode $D\mathbf{7}_1$ and the cathode of the diode $D\mathbf{8}_1$ are connected with each other, and the anode of diode $D\mathbf{8}_1$ is the connecting line NL side. In addition, the connection point between the switching elements $S\mathbf{7}_1$ and $S\mathbf{8}_1$ and the connection point between the diodes $D\mathbf{7}_1$ and $D\mathbf{8}_1$ are connected with each other, and the connecting line between these connection points is connected to the row electrode $Y_1$. Also, the switching elements $S\mathbf{7}_2$, $S\mathbf{8}_2$, diodes $D\mathbf{7}_2$, $D\mathbf{8}_2$, and row electrode $Y_2$, . . . , the switching elements $S\mathbf{7}_k$, $S\mathbf{8}_k$, diodes $D\mathbf{7}_k$, $D\mathbf{8}_k$, and row electrode $Y_k$ are each connected in the same way as the switching elements $S\mathbf{7}_1$, $S\mathbf{8}_1$, diodes $D\mathbf{7}_1$, $D\mathbf{8}_1$, and row electrode $Y_1$.

The switching elements S1 to S6, $S\mathbf{7}_1$ to $S\mathbf{7}_k$, and $S\mathbf{8}_1$ to $S\mathbf{8}_k$ are respectively switched in response to control signals supplied from a control circuit 9.

The sustaining drivers $\mathbf{7}_2$ to $\mathbf{7}_n$ and the sustaining drivers $\mathbf{5}_1$ to $\mathbf{5}_n$ of the X row electrode drivers $\mathbf{3}_1$ to $\mathbf{3}_n$ are also provided with the same configuration as the sustaining driver $\mathbf{7}_1$. However, for the sustaining drivers $\mathbf{5}_1$ to $\mathbf{5}_n$ of the X row electrode drivers $\mathbf{3}_1$ to $\mathbf{3}_n$, the power supply B1 is connected with the reverse polarity of that for the sustaining drivers $\mathbf{7}_1$ to $\mathbf{7}_n$. In addition, the scan drivers $\mathbf{8}_2$ to $\mathbf{8}_n$ and the output drivers $\mathbf{6}_1$ to $\mathbf{6}_n$ of the X row electrode drivers $\mathbf{3}_1$ to $\mathbf{3}_n$ are also provided with the same configuration as the scan driver $\mathbf{8}_1$.

An operation of the PDP drive apparatus having the configuration as mentioned above, and more particularly, of the sustaining driver $7_1$ and scan driver $8_1$, will be explained next with reference to a timing chart in FIG. 3. The operation of the PDP drive apparatus has a reset period, an address period, and a sustaining period.

First, when a reset period starts, the sustaining drivers $5_1$ to $5_n$ of the X row electrode drivers $3_1$ to $3_n$ and the sustaining drivers $7_1$ to $7_n$ of the Y row electrode drivers $4_1$ to $4_n$ each generate reset pulses. The reset pulses are applied simultaneously to the row electrodes $X_1$ to $X_{nk}$ and row electrodes $Y_1$ to $Y_{nk}$. FIG. 3 shows a negative reset pulse that is applied to the row electrode $X_1$ and a positive reset pulse that is applied to the row electrode $Y_1$.

In the sustaining driver $7_1$ and the scan driver $8_1$, the operation during the reset period is as follows. In the sustaining driver $7_1$, the switching element S6 is turned on, and the switching elements S1 to S5 are turned off. In the scan driver $8_1$, the switching elements $S7_1$ to $S7_k$ are turned on, and the switching elements $S8_1$ to $S8_k$ are turned off. As a result, a current flows from the positive terminal of the power supply B1 to the row electrodes $Y_1$ to $Y_k$ via the resistor R1, connecting line YL, and switching elements $S7_1$ to $S7_k$, voltages that are applied to the row electrodes $Y_1$ to $Y_k$ gradually increase due to the capacitance components between the row electrodes $X_1$ to $X_k$ and $Y_1$ to $Y_k$, and positive reset pulses are formed as shown in FIG. 3. The voltage of these reset pulses finally increases to a voltage $V_R$. At this time, the switching elements S4 and S5 are turned on and the switching element S6 are turned off. Thus, since the connecting line YL is grounded, the reset pulses disappear.

As a result of the simultaneous applications of these reset pulses to the row electrodes $X_1$ to $X_{nk}$ and row electrodes $Y_1$ to $Y_{nk}$, all the discharge cells of the PDP 1 really discharge, and charged particles are generated. After the discharge ends, wall charges of predetermined amounts are uniformly formed on dielectric layers of all the discharge cells.

After the reset pulses have disappeared, an address period starts. During the address period, the address driver 2 converts pixel data for each pixel based on a video signal to pixel data pulses $DP_1$ to $DP_m$ having voltage values corresponding to logic levels of the pixel data, and applies these voltages sequentially to the column electrodes $D_1$ to $D_m$ for each row. The pixel data pulses $DP_1$ to $DP_m$ are applied for the row electrode $Y_1$ as shown in FIG. 3. A scan pulse is repeatedly applied to the row electrodes $Y_1$ to $Y_{nk}$ in that order by the scan drivers $8_1$ to $8_n$ in synchronism with the individual application timing of the pixel data pulses $DP_1$ to $DP_m$.

In the scan driver $8_1$, the operation during the address period will be explained as follows. First, the switching element $S7_1$ is turned off and the switching element $S8_1$ is turned on at the same time. As a result, a voltage $-V_h$ by the power supply B3 is added to the row electrode $Y_1$, as shown in FIG. 3, to become a scan pulse. The ground potential of 0V is applied to the row electrode $X_1$ as shown in FIG. 3. After the switching element $S7_1$ has been turned on and the switching element $S8_1$ has been turned off at the same time, the switching element $S7_2$ is turned off and the switching element $S8_2$ is turned on at the same time, and then the scan pulse is added to the row electrode $Y_2$. In this manner, the scan pulse is applied sequentially to the row electrodes $Y_1$ to $Y_k$.

Of discharge cells belonging to a row electrode to which a scan pulse is applied, discharges will occur at discharge cells to which positive voltage pixel data pulses are respectively applied at the same time, and most of the wall charge as mentioned above is lost for each of the discharged cells. Since no discharge occurs at the remaining discharge cells to which a scan pulse is applied but no positive voltage pixel data pulse is applied, each wall charge remains. The discharge cells each of which has the wall charge are luminous discharge cells, and the discharged cells each of which has no wall charge are non-luminous discharge cells.

When a sustaining period starts after the address period, the X row electrode drivers $3_1$ to $3_n$ apply a positive voltage sustaining pulse $IP_X$ to the electrodes $X_1$ to $X_{nk}$, and when sustaining pulse $IP_X$ is eliminated, the Y row electrode drivers $4_1$ to $4_n$ apply a sustaining pulse $IP_Y$ to the electrodes $Y_1$ to $Y_{nk}$. The application of the sustaining pulse $IP_X$ to the electrodes $X_1$ to $X_{nk}$ alternates with the application of the sustaining pulse $IP_Y$ to the electrodes $Y_1$ to $Y_{nk}$. Since luminous discharge cells each of which has the wall charge remained repeatedly emit, these cells maintain a luminous state.

In the sustaining driver $7_1$, the switching element S1 is turned on and the switching element S4 is turned off during the sustain period. The potential of the electrode $Y_1$ is substantially equal to the ground potential of 0V when the switching element S4 is turned on. However, when the switching element S4 is turned off and the switching element S1 is turned on, a current flows to the row element $Y_1$ via the coil L1, diode D1, switching element S1, switching element S5, connecting line YL, and switching element $S7_1$ due to a charge stored in the capacitor C, and charges the capacitance component between the row electrodes $Y_1$ and $X_1$. At this time, the potential of the electrode $Y_1$ increases gradually as shown in FIG. 3 due to the time constant of the coil L2 and capacitance component.

Subsequently, the switching element S1 is turned off and the switching element S3 is turned on. As a result, the voltage $V_S$ by the power supply B2 is applied to the row electrode $Y_1$ via the switching element S3, switching element S5, connecting line YL, and switching element $S7_1$. After that, the switching element S3 is turned off and the switching element S2 is turned on, and a current flows into the capacitor C via the diode $D7_1$, connecting line YL, switching element S5, coil L2, diode D2, and switching element S2 from the electrode $Y_1$ due to the charge stored in the capacitance component between the row electrodes $Y_1$ and $X_1$. At this time, the potential of the electrode $Y_1$ decreases gradually as shown in FIG. 3 due to the time constant of the coil L2 and capacitor C. When the potential of the row electrode $Y_1$ is substantially equal to 0V, the switching element S2 is turned off and the switching element S4 is turned on. The row electrode $Y_1$ is supplied with the sustaining pulse $IP_Y$ of a positive voltage as shown in FIG. 3, according to the operation.

The row electrodes $X_1$ to $X_{nk}$ and row electrodes $Y_1$ to $Y_{nk}$ are each divided into n groups having k rows per group, and the X row electrode driver and Y row electrode driver are provided for each row electrode group as described above. The configuration is done to reduce a load for a single driver and distribute the overall generation of heat to each driver.

However, since the switching elements such as FETs, which respond to control signals, have different response speeds from each other in each of the X row electrode drivers and Y row electrode drivers, there are temporal errors in the generation of drive pulses in the row electrode drivers. The temporal errors in the generation of drive pulses cause the following problem. A load is applied to a row electrode driver at which a drive pulse is early generated due to the existence of the connecting line between the row electrode drivers, and the value of an electric current supplied to the row electrode from that row electrode driver increases. Thus, the loaded row electrode driver generates heat. For example, if some delay interval elapses after the Y row electrode driver $\mathbf{4}_1$ starts outputting a sustaining pulse as shown in FIG. 4A before the Y row electrode driver $\mathbf{4}_2$ outputs a sustaining pulse as shown in FIG. 4B, the output current by the drive pulse of the Y row electrode driver $\mathbf{4}_1$ shown in FIG. 4C becomes larger than the output current by the drive pulse of the Y row electrode driver $\mathbf{4}_2$ shown in FIG. 4D, and the amount of heat generated by the Y row electrode driver $\mathbf{4}_1$ increases.

SUMMARY OF THE INVENTION

An object of the present invention is to provide a drive apparatus for a display panel that can make power consumption of a row electrode drive circuit of each row electrode group substantially uniform to prevent an increase in the amount of heat generated therein.

According to the present invention, there is provided a drive apparatus for driving a display panel having a plurality of row electrode groups each including a plurality of row electrodes, and a plurality of column electrodes arrayed in the direction intersecting with each row electrode of the plurality of row electrode groups so as to form display cells at the intersection points; the drive apparatus further comprising: a controller for generating a control signal for each of the row electrode groups; a row electrode drive circuit provided for each of the row electrode groups, for generating a drive pulse in response to the control signal and supplying the drive pulse to each row electrode of the corresponding row electrode group; and an adjusting device for delaying the control signal which is supplied to the drive circuit for each of the row electrode groups.

DESCRIPTION OF THE PREFERRED EMBODIMENTS

Embodiments of the present invention will be described in detail below with reference to the figures.

Figure 1:
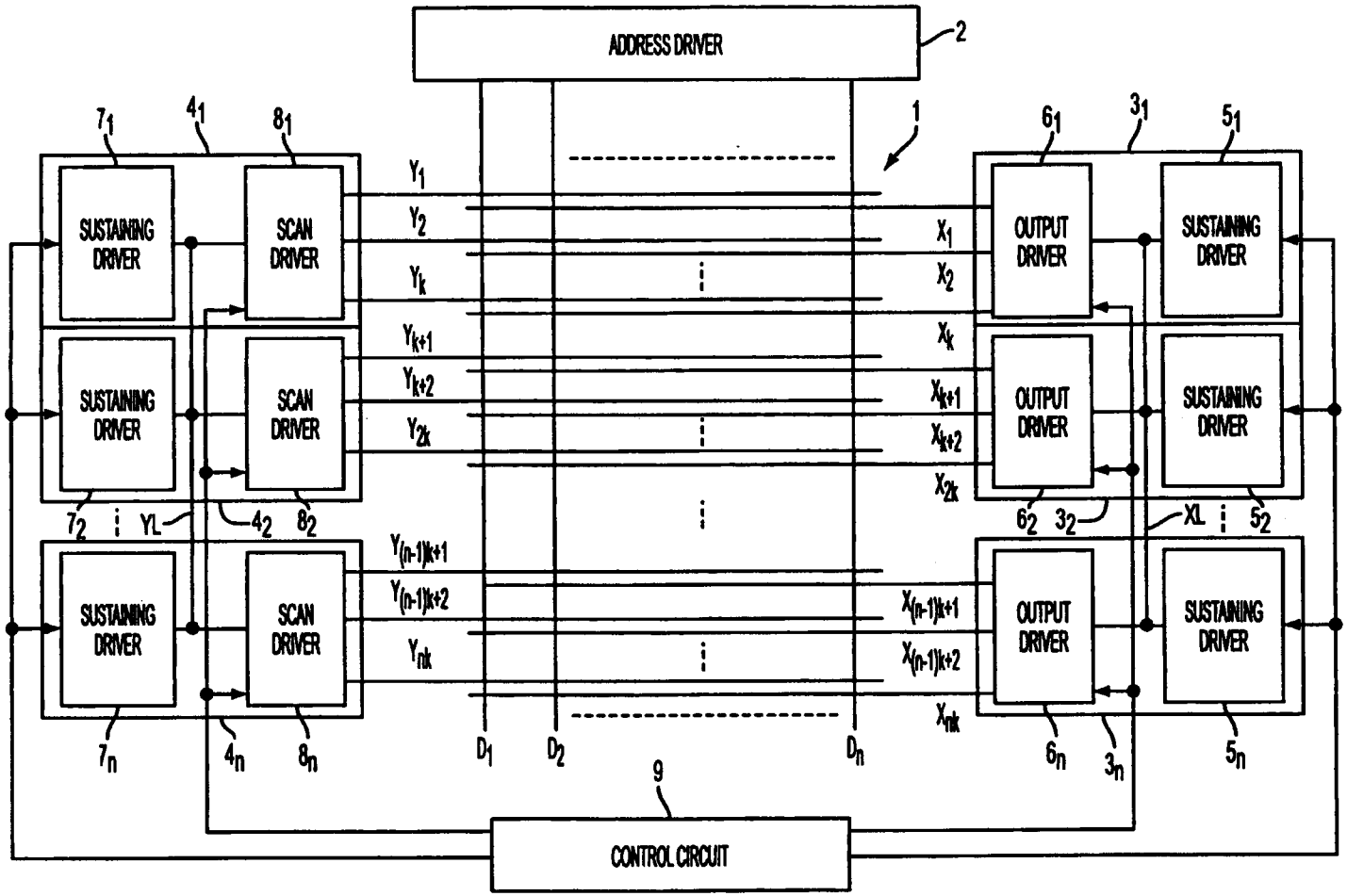
FIG. 1 PRIOR ART
FIG. 1 is a block diagram showing a conventional PDP drive apparatus.
Figure 2:
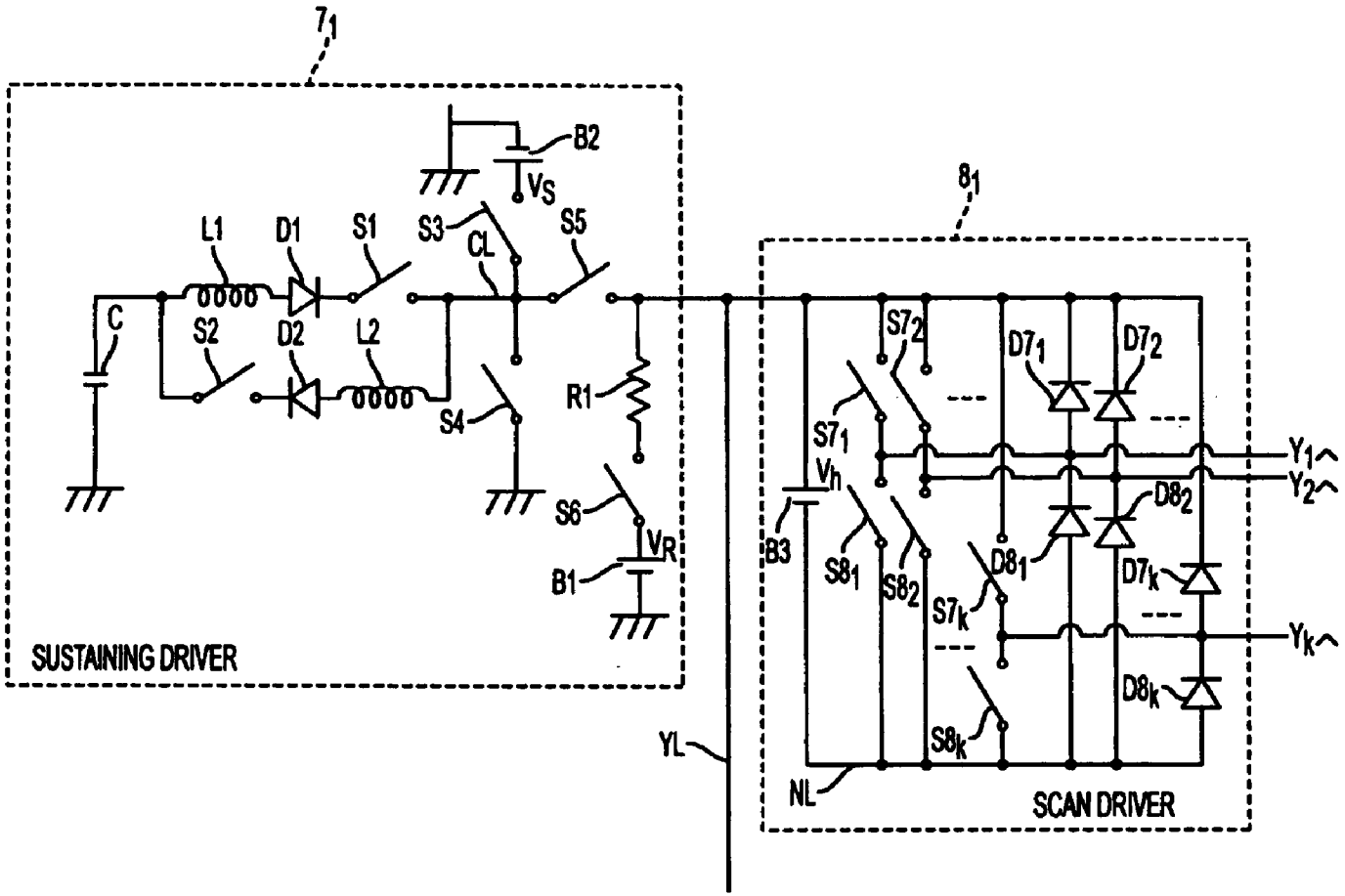
FIG. 2 PRIOR ART
FIG. 2 is a circuit diagram showing the configuration of a conventional drive apparatus.
Figure 3:
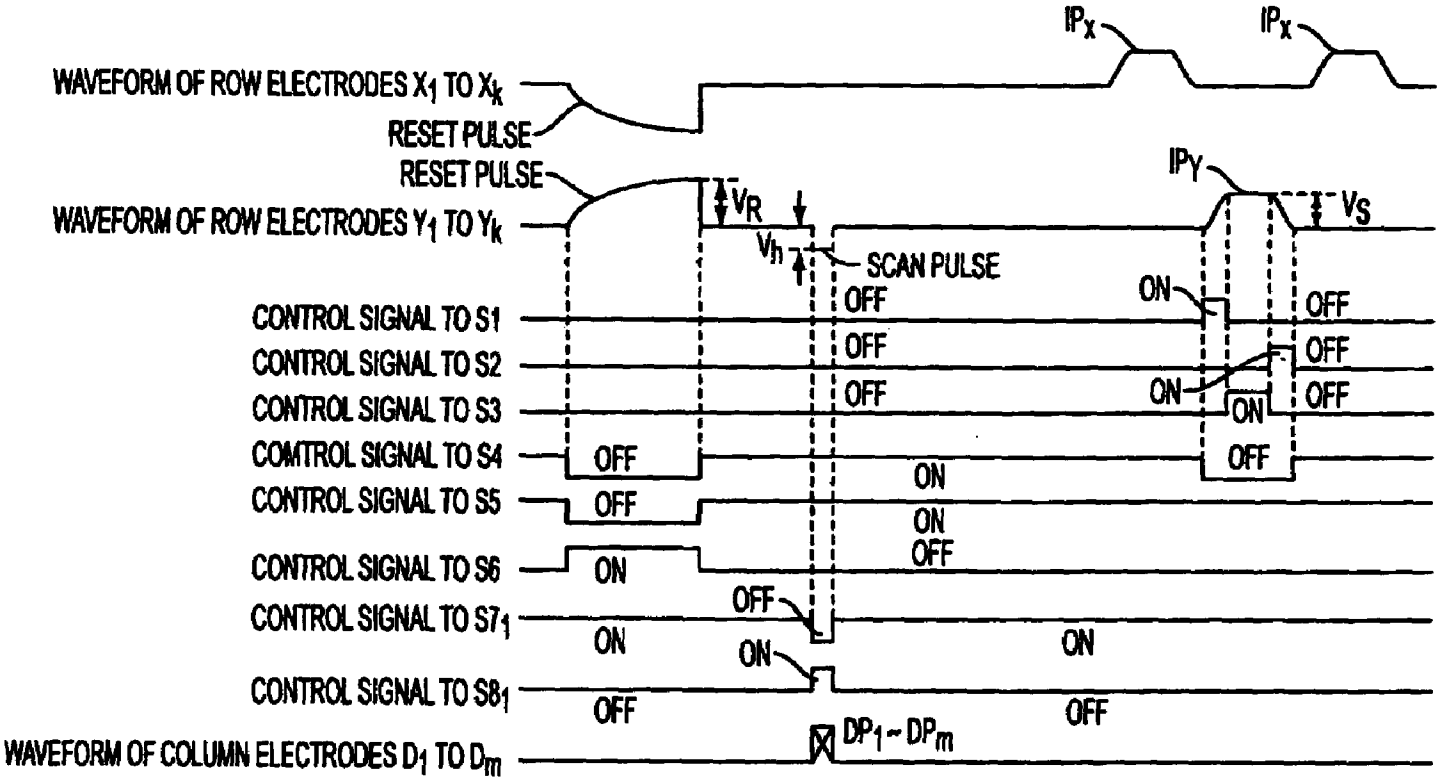
FIG. 3 PRIOR ART
FIG. 3 is a timing chart of each part of the apparatus in FIG. 2.
Figures 4A, 4B, 4C, 4D:
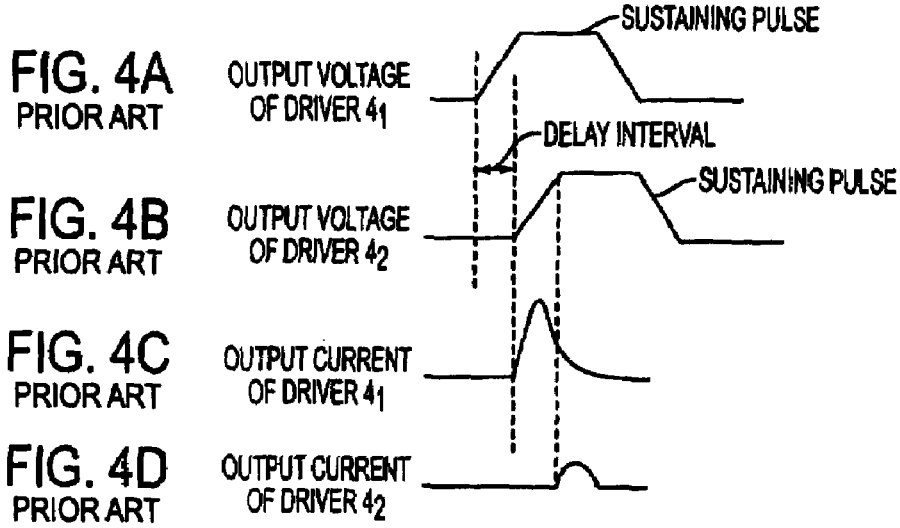
FIG. 4A PRIOR ART
FIG. 4B PRIOR ART
FIG. 4C PRIOR ART
FIG. 4D PRIOR ART
FIGS. 4A to 4D show timing of sustaining pulses and drive current waveforms.
Figure 5:
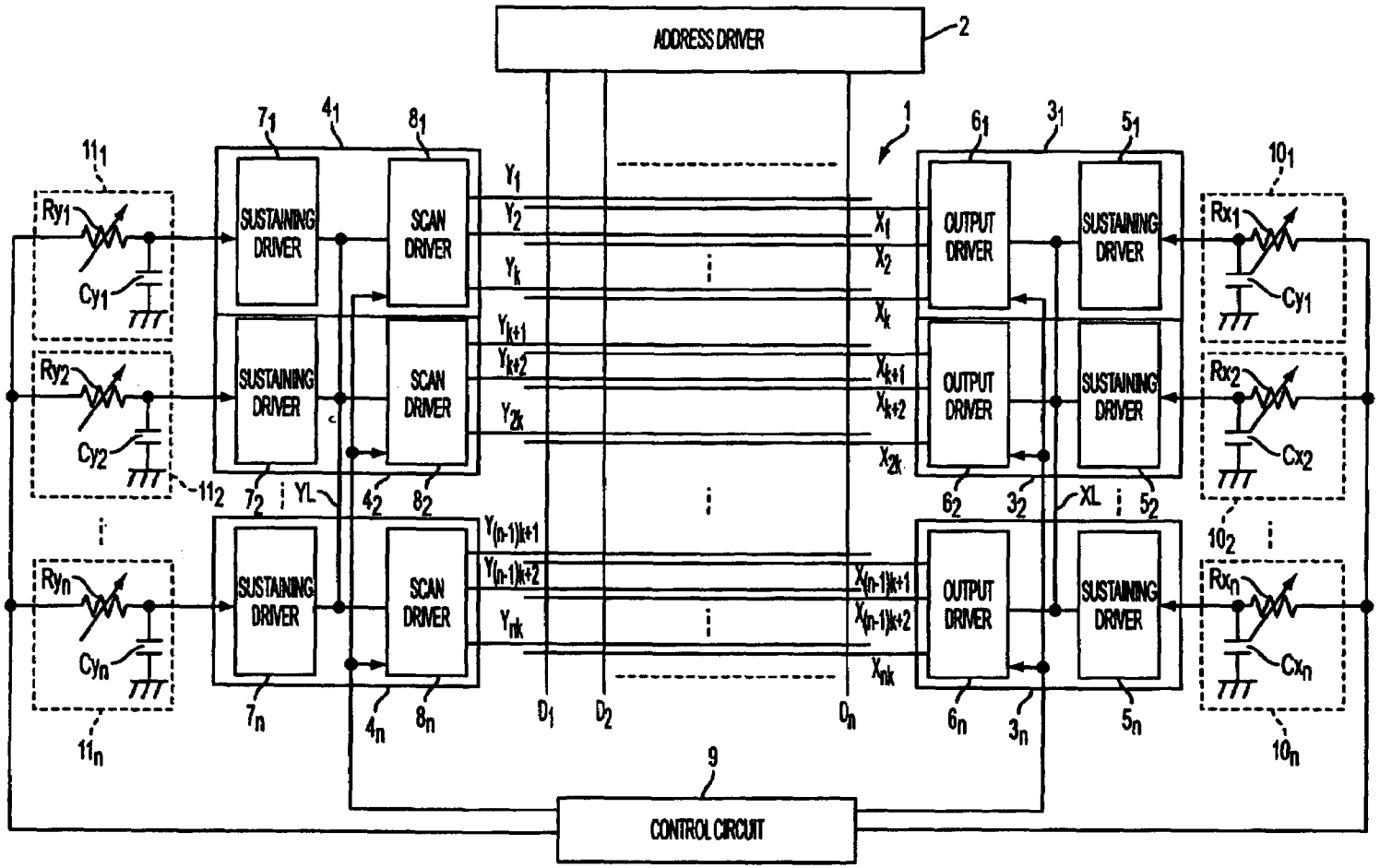
FIG. 5 is a block diagram showing an embodiment of the present invention.

FIG. 5 shows the configuration of a PDP drive apparatus according to the present invention. In FIG. 5, the same symbols are used for the same parts as those used in the conventional apparatus shown in FIG. 1. In the PDP drive apparatus of FIG. 5, delay circuits $\mathbf{10}_1$ to $\mathbf{10}_n$ are respectively inserted between the control circuit 9 and the sustaining drivers $\mathbf{5}_1$ to $\mathbf{5}_n$ of the X row electrode drivers $\mathbf{3}_1$ to $\mathbf{3}_n$, respectively, and delay circuits $\mathbf{11}_1$ to $\mathbf{11}_n$ are similarly inserted between the control circuit 9 and the sustaining drivers $\mathbf{7}_1$ to $\mathbf{7}_n$ of the Y row electrode drivers $\mathbf{4}_1$ to $\mathbf{4}_n$, respectively. That is, control signals for switching the switching elements of the sustaining drivers $\mathbf{5}_1$ to $\mathbf{5}_n$ are respectively supplied from the control circuit 9 to the sustaining drivers $\mathbf{5}_1$ to $\mathbf{5}_n$ via the delay circuits $\mathbf{10}_1$ to $\mathbf{10}_n$. Also, control signals for switching the switching elements of the sustaining drivers $\mathbf{7}_1$ to $\mathbf{7}_n$ are respectively supplied from the control circuit 9 to the sustaining drivers $\mathbf{7}_1$ to $\mathbf{7}_n$ via the delay circuits $\mathbf{11}_1$ to $\mathbf{11}_n$.

The delay circuits $\mathbf{10}_1$ to $\mathbf{10}_n$ and delay circuits $\mathbf{11}_1$ to $\mathbf{11}_n$ are formed by integrating circuits having resistors $Rx_1$ to $Rx_n$, $Ry_1$ to $Ry_n$ and capacitors $Cx_1$ to $Cx_n$, $Cy_1$ to $Cy_n$, respectively, as shown in FIG. 5. The resistors $Rx_1$ to $Rx_n$ and $Ry_1$ to $Ry_n$ are variable resistors, which can change the delay times of the delay circuits $\mathbf{10}_1$ to $\mathbf{10}_n$ and delay circuits $\mathbf{11}_1$ to $\mathbf{11}_n$, respectively, in accordance with manual operation.

Figure 9:
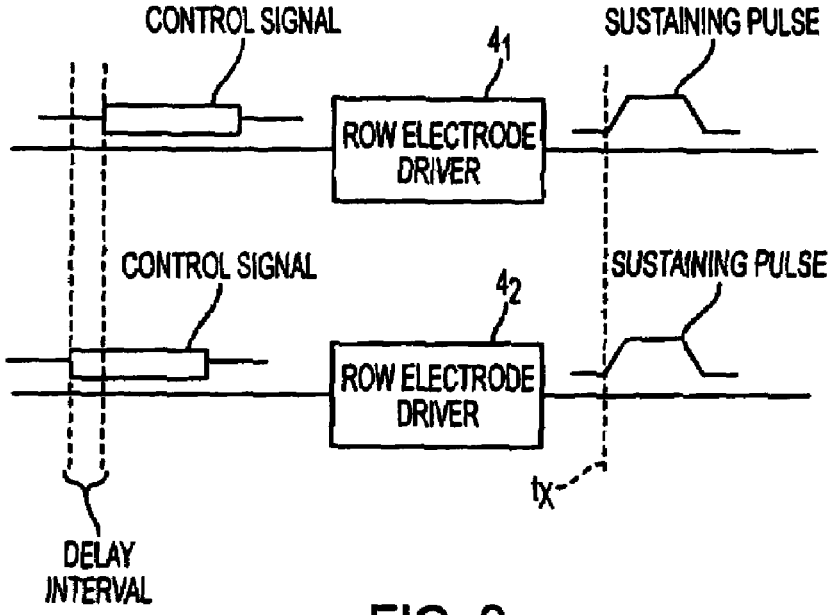
FIG. 9 is a diagram showing timing of control signals and drive pulses.

By setting longer the delay times of the delay circuits connected to sustaining drivers having faster responses to control signals from the control circuit 9, the respective sustaining drivers (switching elements S1 to S6) can be activated at the same timing. Therefore, drive pulses (reset pulse pulses and sustaining pulses) can be generated at the same timing, as shown by the sustaining pulses output from the drivers $\mathbf{4}_1$ and $\mathbf{4}_2$ in FIG. 9. As a result, the values of electric currents supplied to the row electrodes $X_1$ to $X_{nk}$ from the output drivers $\mathbf{6}_1$ to $\mathbf{6}_n$ of the X row electrode drivers $\mathbf{3}_1$ to $\mathbf{3}_n$, respectively, become substantially uniform, and similarly, the values of electric currents supplied to the row electrodes $Y_1$ to $Y_{nk}$ from the scan drivers $\mathbf{8}_1$ to $\mathbf{8}_n$ of Y row electrode drivers $\mathbf{4}_1$ to $\mathbf{4}_n$, respectively, become substantially uniform. Heat generated in respective elements such as switching elements is distributed to each of the row electrode drivers $\mathbf{3}_1$ to $\mathbf{3}_n$, $\mathbf{4}_1$ to $\mathbf{4}_n$.

Figure 6:
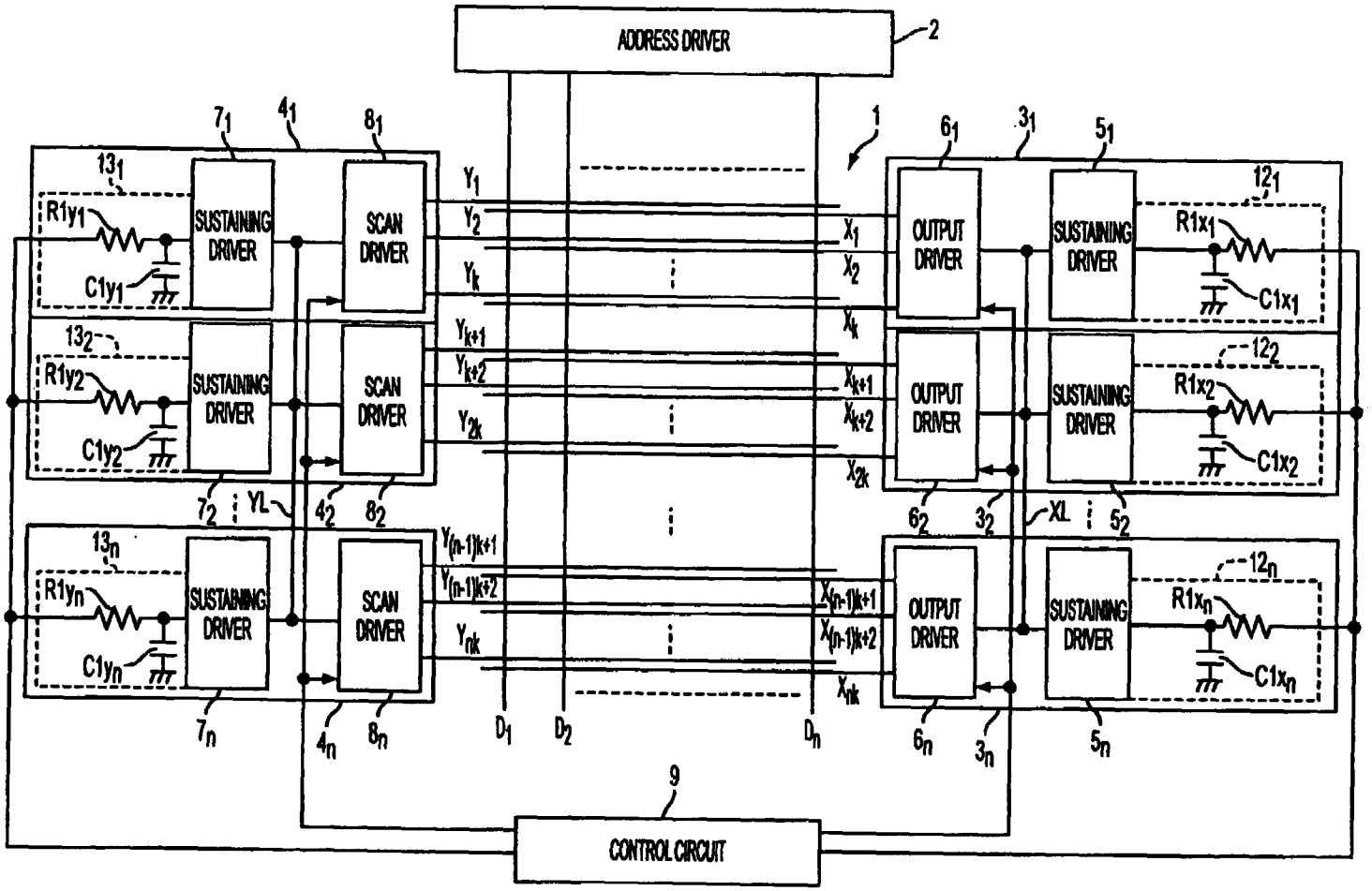
FIG. 6 is a block diagram showing another embodiment of the present invention.

FIG. 6 shows the configuration of a PDP drive apparatus of another embodiment of the present invention. In FIG. 6, the same symbols are used for the same parts as those used in the conventional apparatus shown in FIG. 1. The PDP drive apparatus of FIG. 6 has delay circuits $\mathbf{12}_1$ to $\mathbf{12}_n$, $\mathbf{13}_1$ to $\mathbf{13}_n$ in a similar manner as those in the apparatus of FIG. 5. In the drive apparatus of FIG. 6, the sustaining drivers $\mathbf{5}_1$ to $\mathbf{5}_n$ are modularized in a configuration including the delay circuits $\mathbf{12}_1$ to $\mathbf{12}_n$, respectively. Similarly, the sustaining drivers $\mathbf{7}_1$ to $\mathbf{7}_n$ are modularized in a configuration including the delay circuits $\mathbf{13}_1$ to $\mathbf{13}_n$, respectively.

The delay circuits $\mathbf{12}_1$ to $\mathbf{12}_n$, $\mathbf{13}_1$ to $\mathbf{13}_n$ are formed by integrating circuits including resistors $R1x_1$ to $R1x_n$, $R1y_1$ to $R1y_n$ and capacitors $C1x_1$ to $C1x_n$, $C1y_1$ to $C1y_n$, respectively, as shown in FIG. 6. The resistors $R1x_1$ to $R1x_n$, $R1y_1$ to $R1y_n$ and capacitors $C1x_1$ to $C1x_n$, $C1y_1$ to $C1y_n$, have positive temperature characteristics.

In the configuration shown in FIG. 6, if the value of a current supplied to any of the row electrodes $X_1$ to $X_{nk}$, $Y_1$ to $Y_{nk}$ is large and the amount of heat generated by the corresponding sustaining driver increases, the resistance value, for example, of the delay circuit within that sustaining driver increases for generating heat, and the delay time of the delay circuit becomes longer. The respective sustaining drivers (switching elements S1 to S6) can be activated at the same timing. Therefore, drive pulses (reset pulse pulses and sustaining pulses) can be generated at the same timing. As a result, the values of electric currents supplied to the row electrodes $X_1$ to $X_{nk}$ from the output drivers $\mathbf{6}_1$ to $\mathbf{6}_n$ of the X row electrode drivers $3_1$ to $3_n$, respectively, become substantially uniform, and similarly, the values of electric currents supplied to the row electrodes $Y_1$ to $Y_{nk}$ from the scan drivers $8_1$ to $8_n$ of Y row electrode drivers $4_1$ to $4_n$, respectively, become substantially uniform. Heat generated in respective elements such as switching elements is distributed to each of the row electrode drivers $3_1$ to $3_n$, $4_1$ to $4_n$.

Figure 7:
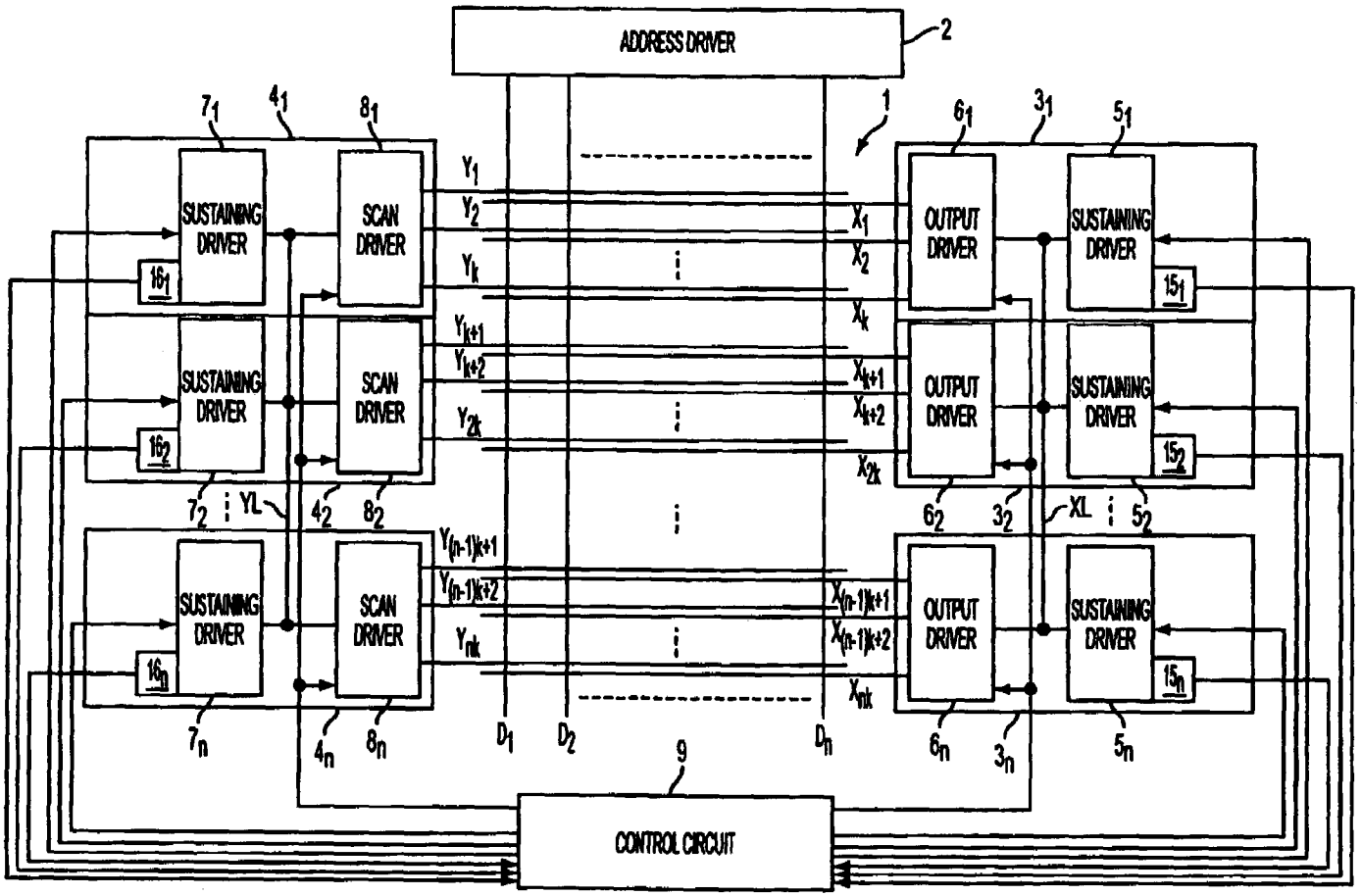
FIG. 7 is a block diagram showing another embodiment of the present invention.

FIG. 7 shows the configuration of a PDP drive apparatus of another embodiment of the present invention. In FIG. 7, the same symbols are used for the same parts as those used in the conventional apparatus shown in FIG. 1. The PDP drive apparatus of FIG. 7 has temperature sensors $15_1$ to $15_n$ which are attached to the sustaining drivers $5_1$ to $5_n$ of the X row electrode drivers $3_1$ to $3_n$, respectively. The temperature sensors $15_1$ to $15_n$ detect the temperatures of the sustaining drivers $5_1$ to $5_n$ and supply signals indicating the detected temperatures to the control circuit 9. The PDP drive apparatus of FIG. 7 also has temperature sensors temperature sensors $16_1$ to $16_n$ which are attached to the sustaining drivers $7_1$ to $7_n$ of the Y row electrode drivers $4_1$ to $4_n$, respectively. The temperature sensors $16_1$ to $16_n$ detect the temperatures of the sustaining drivers $7_1$ to $7_n$ and supply signals indicating the detected temperatures to the control circuit 9.

The control circuit 9 monitors the detected temperatures indicated by the signals supplied from the temperature sensors $15_1$ to $15_n$, $16_1$ to $16_n$, respectively, and delays the supply timing of a control signal to the corresponding sustaining driver when a increase in any of the detected temperatures is detected, or advances the supply timing of the control signal to the corresponding sustaining driver when a decrease in any of the detected temperature is detected.

By the timing control operation based on the detected temperatures, the respective sustaining drivers (switching elements S1 to S6) can be activated at the same timing. Therefore, drive pulses (reset pulse pulses and sustaining pulses) can be generated at the same timing. As a result, the values of electric currents supplied to the row electrodes $X_1$ to $X_{nk}$ from the output drivers $6_1$ to $6_n$ of the X row electrode drivers $3_1$ to $3_n$, respectively, become substantially uniform, and similarly, the values of electric currents supplied to the row electrodes $Y_1$ to $Y_{nk}$ from the scan drivers $8_1$ to $8_n$ of Y row electrode drivers $4_1$ to $4_n$, respectively, become substantially uniform. Heat generated in respective elements such as switching elements is distributed to each of the row electrode drivers $3_1$ to $3_n$, $4_1$ to $4_n$.

Figure 8:
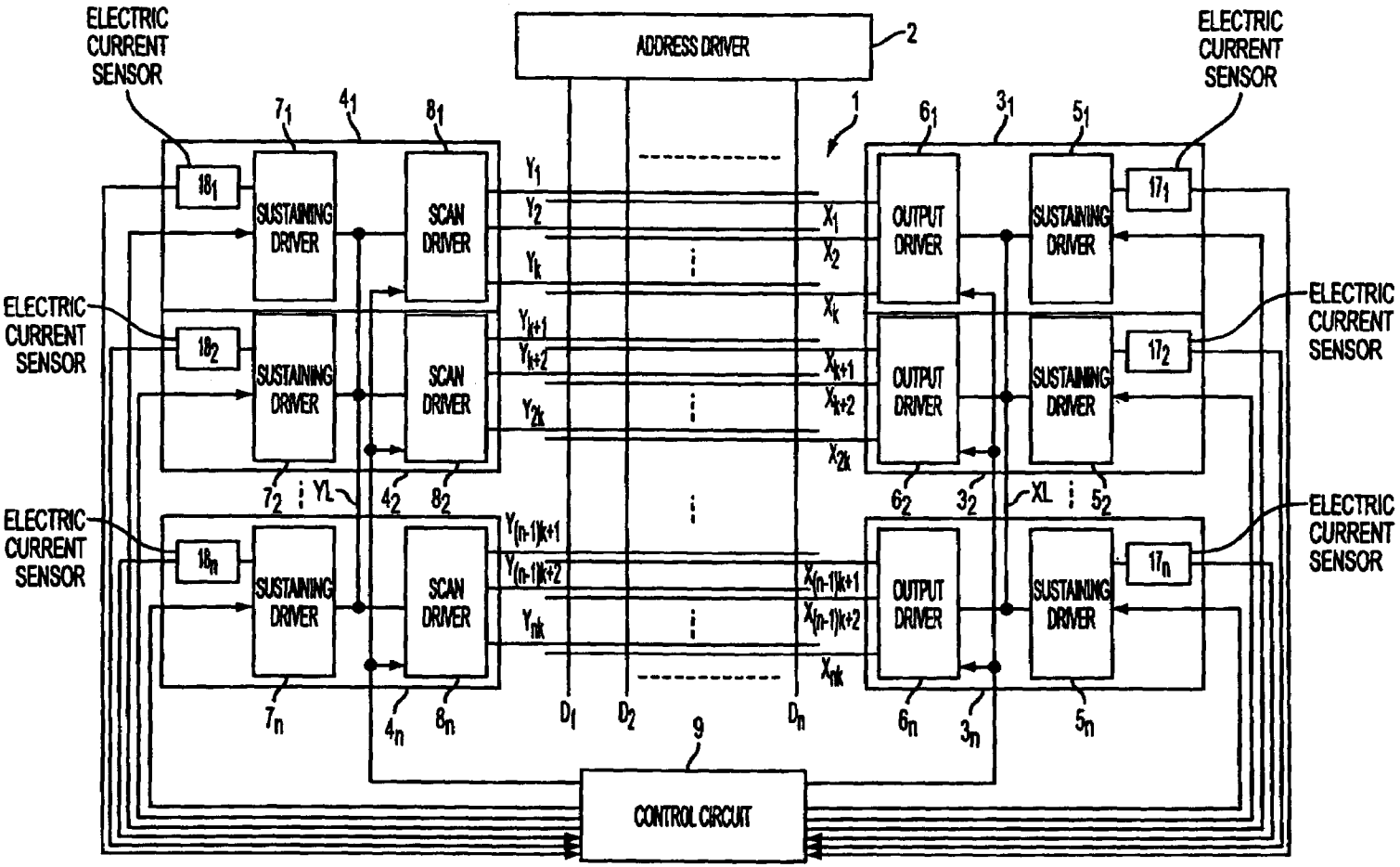
FIG. 8 is a block diagram showing still another embodiment of the present invention.

FIG. 8 shows the configuration of a PDP drive apparatus of another embodiment of the present invention. In FIG. 8, the same symbols are used for the same parts as those used in the conventional apparatus shown in FIG. 1. The PDP drive apparatus of FIG. 8 has electric current sensors $17_1$ to $17_n$ for each detecting the value of the current output from the positive terminal of the power source B2 in each of the sustaining drivers $5_1$ to $5_n$ of the X row electrode drivers $3_1$ to $3_n$. The PDP drive apparatus of FIG. 8 also has electric current sensors $18_1$ to $18_n$ for each detecting the value of the current output from the positive terminal of the power source B2 in each of the sustaining drivers $7_1$ to $7_n$ of the Y row electrode drivers $4_1$ to $4_n$. The detected outputs of the electric current sensors $17_1$ to $17_n$, $18_1$ to $18_n$ are supplied to the control circuit 9.

The control circuit 9 monitors the detected current values indicated by the signals supplied from the electric current sensors $17_1$ to $17_n$, $18_1$ to $18_n$, respectively, and delays the supply timing of the control signal to the corresponding sustaining driver if a increase in any of the detected current values is detected, or advances the supply timing of the control signal to the corresponding sustaining driver if a decrease in any of the detected current values is detected.

By the timing control operation based on the detected current values, the respective sustaining drivers (switching elements S1 to S6) can be activated at the same timing. Therefore, drive pulses (reset pulse pulses and sustaining pulses) can be generated at the same timing. As a result, the values of electric currents supplied to the row electrodes $X_1$ to $X_{nk}$ from the output drivers $6_1$ to $6_n$ of the X row electrode drivers $3_1$ to $3_n$, respectively, become substantially uniform, and similarly, the values of electric currents supplied to the row electrodes $Y_1$ to $Y_{nk}$ from the scan drivers $8_1$ to $8_n$ of Y row electrode drivers $4_1$ to $4_n$, respectively, become substantially uniform. Heat generated in respective elements such as switching elements is distributed to each of the row electrode drivers $3_1$ to $3_n$, $4_1$ to $4_n$.

When the PDP 1 is installed so that the display surface is vertical, the temperature of the upper part of the PDP 1 increases more than that of the lower part. Even if the values of the electric current output to the row electrodes from each of the row electrode drivers are substantially equal to each other as described above, the sustaining pulses can be output earlier, by intentionally adjusting the timing of the control signals in consideration of the increase the temperature in the upper part of the PDP 1, or by advancing the timing of control signals supplied to some sustaining drivers located in the lower part of the PDP 1. As a result, when the temperature of the upper part of the PDP 1 increases more than that of the lower part, heat generated by the row electrode drivers can be uniformed by increasing the values of the electric currents output to the row electrodes from the row electrode drivers of the lower part of the PDP 1.

Since the present invention can make the electric power consumption of the row electrode drive circuit of each row electrode group substantially uniform as described above, an increase in the amount of heat generated by each row electrode circuit can be prevented.

This application is based on a Japanese Patent Application No. 2001-137207 which is hereby incorporated by reference.

What is claimed is:

1. A drive apparatus for driving a display panel having a plurality of row electrode groups each including a plurality of row electrodes, and a plurality of column electrodes arrayed in the direction intersecting with each row electrode of said plurality of row electrode groups so as to form display cells at the intersection points; said drive apparatus further comprising:

a controller for generating a control signal for each of said row electrode groups;

a row electrode drive circuit provided for each of said row electrode groups, for generating a drive pulse in response to said control signal and supplying the drive pulse to each row electrode of the corresponding row electrode group; and an adjusting device for delaying the control signal which is supplied to said drive circuit for each of said row electrode groups so that the drive circuits of all of said row electrode groups respectively generate the drive pulses at the same timing, wherein said adjusting device is a delay circuit including a variable resistor and a capacitor provided for each of said row electrode groups.

2. A drive apparatus according to claim 1, wherein said display panel is a plasma display panel, and said row electrode drive circuit generates a sustaining pulse as the drive pulse.

3. A drive apparatus for driving a display panel, wherein the display panel includes at least a first electrode group and a second electrode group, wherein the first electrode group has a plurality of first electrodes arrayed in a first direction, wherein the second electrode group has a plurality of second electrodes arrayed in the first direction, wherein the display panel includes third electrodes arrayed in a second direction different from the first direction, and wherein the drive apparatus comprises:

a drive circuit that drives the first electrodes in the first electrode group and that drives the second electrodes in the second electrode group;

a control circuit that outputs a first control signal and a second control signal to the drive circuit, wherein the first control signal instructs the drive circuit to drive the first electrodes in the first electrode group, and wherein the second control signal instructs the drive circuit to drive the second electrodes in the second electrode group, wherein at least one of (1) a first timing at which the first control signal is applied to the drive circuit and (2) a second timing at which the second control signal is applied to the drive circuit is altered so that the drive circuit substantially simultaneously drives the first electrode group and the second electrode group; and a first current sensor that detects a first current output from a power source of the drive circuit, wherein the control circuit adjusts at least one of (1) the first timing at which the first control signal is applied to the drive circuit and (2) the second timing at which the second control signal is applied to the drive circuit based on the first current.

4. A drive apparatus for driving a display panel having a plurality of row electrode groups each including a plurality of row electrodes, and a plurality of column electrodes arrayed in the direction intersecting with each row electrode of said plurality of row electrode groups so as to form display cells at the intersection points; said drive apparatus further comprising:

a controller for generating a control signal for each of said row electrode groups;

a row electrode drive circuit provided for each of said row electrode groups, for generating a drive pulse in response to said control signal and supplying the drive pulse to each row electrode of the corresponding row electrode group; and an adjusting device for delaying the control signal which is supplied to said drive circuit for each of said row electrode groups so that the drive circuits of all of said row electrode groups respectively generate the drive pulses at the same timing, wherein said adjusting device is a delay circuit including an element having a positive temperature characteristic, which is provided for each of said row electrode groups, and said delay circuit is located in the vicinity of said row electrode drive circuit.

5. A drive apparatus for driving a display panel having a plurality of row electrode groups each including a plurality of row electrodes, and a plurality of column electrodes arrayed in the direction intersecting with each row electrode of said plurality of row electrode groups so as to form display cells at the intersection points; said drive apparatus further comprising:

a controller for generating a control signal for each of said row electrode groups;

a row electrode drive circuit provided for each of said row electrode groups, for generating a drive pulse in response to said control signal and supplying the drive pulse to each row electrode of the corresponding row electrode group; and an adjusting device for delaying the control signal which is supplied to said drive circuit for each of said row electrode groups so that the drive circuits of all of said row electrode groups respectively generate the drive pulses at the same timing, wherein said adjusting device has, for each of said row electrode groups, a temperature sensor for detecting the temperature of said drive circuit, and an adjusting circuit for adjusting the delay time for supplying the control signal to said drive circuit in accordance with the temperature detected by said temperature sensor.

6. A drive apparatus according to claim 5, wherein said adjusting circuit lengthens the delay time for supplying said control signal to said drive circuit as the temperature detected by said temperature sensor is higher.

7. A drive apparatus for driving a display panel having a plurality of row electrode groups each including a plurality of row electrodes, and a plurality of column electrodes arrayed in the direction intersecting with each row electrode of said plurality of row electrode groups so as to form display cells at the intersection points; said drive apparatus further comprising:

a controller for generating a control signal for each of said row electrode groups;

a row electrode drive circuit provided for each of said row electrode groups, for generating a drive pulse in response to said control signal and supplying the drive pulse to each row electrode of the corresponding row electrode group; and an adjusting device for delaying the control signal which is supplied to said drive circuit for each of said row electrode groups so that the drive circuits of all of said row electrode groups respectively generate the drive pulses at the same timing, wherein said adjusting device has, for each of said row electrode groups, an electric current sensor for detecting the value of a current output from a power source for said drive circuit, and a adjusting circuit for adjusting the delay time for supplying the control signal to said drive circuit in accordance with the value of the current detected by said electric current sensor.

8. A drive apparatus according to claim 7, wherein said adjusting circuit lengthens the delay time for supplying said control signal to said drive circuit as the value of the current detected by said electric current sensor is higher.

9. A drive apparatus for driving a display panel, wherein the display panel includes at least a first electrode group and a second electrode group, wherein the first electrode group has a plurality of first electrodes arrayed in a first direction, wherein the second electrode group has a plurality of second electrodes arrayed in the first direction, wherein the display panel includes third electrodes arrayed in a second direction different from the first direction, and wherein the drive apparatus comprises:

a first driver circuit that drives the first electrodes in the first electrode group;

a second driver circuit that drives the second electrodes in the second electrode group;

a control circuit that outputs a first control signal to the first driver circuit and a second control signal to the second driver circuit, wherein the first control signal instructs the first driver circuit to drive the first electrodes in the first electrode group, and wherein the second control signal instructs the second driver circuit to drive the second electrodes in the second electrode group, wherein at least one of (1) a first timing at which the first control signal is applied to the first driver circuit and (2) a second timing at which the second control signal is applied to the second driver circuit is altered so that the first driver circuit and the second driver circuit substantially simultaneously drive the first electrode group and the second electrode group, respectively; and a first temperature sensor that detects a first temperature of the first driver circuit, wherein the control circuit adjusts at least one of (1) the first timing at which the first control signal is applied to the first driver circuit and (2) the second timing at which the second control signal is applied to the second driver circuit based on the first temperature.

10. The apparatus according to claim 9, further comprising:

a second temperature sensor that detects a second temperature of the second driver circuit, wherein the control circuit adjusts at least one of (1) the first timing at which the first control signal is applied to the first driver circuit and (2) the second timing at which the second control signal is applied to the second driver circuit based on the second temperature.

11. The apparatus according to claim 10, wherein the control circuit adjusts the first timing at which the first control signal is applied to the first driver circuit based on the first temperature, and wherein the control circuit adjusts the second timing at which the second control signal is applied to the second driver circuit based on the second temperature.

12. The apparatus according to claim 10, wherein at least one of the first timing and the second timing is altered so that the first driver circuit and the second driver circuit substantially simultaneously drive the first electrode group and the second electrode group.

13. A drive apparatus for driving a display panel, wherein the display panel includes at least a first electrode group and a second electrode group, wherein the first electrode group has a plurality of first electrodes arrayed in a first direction, wherein the second electrode group has a plurality of second electrodes arrayed in the first direction, wherein the display panel includes third electrodes arrayed in a second direction different from the first direction, and wherein the drive apparatus comprises:

a first driver circuit that drives the first electrodes in the first electrode group;

a second driver circuit that drives the second electrodes in the second electrode group;

a control circuit that outputs a first control signal to the first driver circuit and a second control signal to the second driver circuit, wherein the first control signal instructs the first driver circuit to drive the first electrodes in the first electrode group, and wherein the second control signal instructs the second driver circuit to drive the second electrodes in the second electrode group;

a first delay circuit disposed between the control circuit and the first driver circuit for delaying the first control signal; and a second delay circuit disposed between the control circuit and the second driver circuit for delaying the second control signal, wherein at least one of (1) a first timing at which the first control signal is applied to the first driver circuit through the first delay circuit and (2) a second timing at which the second control signal is applied to the second driver circuit through the second delay circuit is altered so that the first driver circuit and the second driver circuit substantially simultaneously drive the first electrode group and the second electrode group respectively.

14. The apparatus according to claim 13, wherein at least one of the first timing and the second timing is altered so that the first driver circuit and the second driver circuit substantially simultaneously drive the first electrode group and the second electrode group.

15. The apparatus according to claim 13, wherein the first delay circuit comprises a first variable resistor and a first capacitor to delay the first control signal.

16. The apparatus according to claim 15, wherein the second delay circuit comprises a second variable resistor and a second capacitor to delay the second control signal.

17. The apparatus according to claim 13, wherein the first delay circuit comprises first circuitry having a temperature characteristic such that a first delay time of the first circuitry changes as a first temperature of the first driver circuit changes.

18. The apparatus according to claim 17, wherein the first circuitry comprises a first resistor and a first capacitor.

19. The apparatus according to claim 17, wherein the second delay circuit comprises second circuitry having a temperature characteristic such that a second delay time of the second circuitry changes as a second temperature of the second driver circuit changes.

20. The apparatus according to claim 19, wherein the first circuitry comprises a first resistor and a first capacitor, and wherein the second circuitry comprises a second resistor and a second capacitor.

21. The apparatus according to claim 19, wherein at least one of the first timing and the second timing is altered so that the first driver circuit and the second driver circuit substantially simultaneously drive the first electrode group and the second electrode group.

22. A drive apparatus for driving a display panel, wherein the display panel includes at least a first electrode group and a second electrode group, wherein the first electrode group has a plurality of first electrodes arrayed in a first direction, wherein the second electrode group has a plurality of second electrodes arrayed in the first direction, wherein the display panel includes third electrodes arrayed in a second direction different from the first direction, and wherein the drive apparatus comprises:

a drive circuit that drives the first electrodes in the first electrode group and that drives the second electrodes in the second electrode group;

a control circuit that outputs a first control signal and a second control signal to the drive circuit, wherein the first control signal instructs the drive circuit to drive the first electrodes in the first electrode group, and wherein the second control signal instructs the drive circuit to drive the second electrodes in the second electrode group, wherein at least one of (1) a first timing at which the first control signal is applied to the drive circuit and (2) a second timing at which the second control signal is applied to the drive circuit is altered so that the drive circuit substantially simultaneously drives the first electrode group and the second electrode group; and a first temperature sensor that detects a first temperature of the drive circuit, wherein the control circuit adjusts at least one of (1) the first timing at which the first control signal is applied to the drive circuit and (2) the second timing at which the second control signal is applied to the drive circuit based on the first temperature.

23. A drive apparatus for driving a display panel, wherein the display panel includes at least a first electrode group and a second electrode group, wherein the first electrode group has a plurality of first electrodes arrayed in a first direction, wherein the second electrode group has a plurality of second electrodes arrayed in the first direction, wherein the display panel includes third electrodes arrayed in a second direction different from the first direction, and wherein the drive apparatus comprises;

a first driver circuit that drives the first electrodes in the first electrode group;

a second driver circuit that drives the second electrodes in the second electrode group;

a control circuit that outputs a first control signal to the first driver circuit and a second control signal to the second driver circuit, wherein the first control signal instructs the first driver circuit to drive the first electrodes in the first electrode group, and wherein the second control signal instructs the second driver circuit to drive the second electrodes in the second electrode group, wherein at least one of (1) a first timing at which the first control signal is applied to the first driver circuit and (2) a second timing at which the second control signal is applied to the second driver circuit is altered so that the first driver circuit and the second driver circuit substantially simultaneously drive the first electrode group and the second electrode group, respectively; and a first current sensor that detects a first current output from a first power source of the first driver circuit, wherein the control circuit adjusts at least one of (1) the first timing at which the first control signal is applied to the first driver circuit and (2) the second timing at which the second control signal is applied to the second driver circuit based on the first current.

24. The apparatus according to claim 23, further comprising:

a second current sensor that detects a second current output from a second power source of the second driver circuit, wherein the control circuit adjusts at least one of (1) the first timing at which the first control signal is applied to the first driver circuit and (2) the second timing at which the second control signal is applied to the second driver circuit based on the second current.

25. The apparatus according to claim 24, wherein the control circuit adjusts the first timing at which the first control signal is applied to the first driver circuit based on the first current, and wherein the control circuit adjusts the second timing at which the second control signal is applied to the second driver circuit based on the second current.

26. The apparatus according to claim 24, wherein at least one of the first timing and the second timing is altered so that the first driver circuit and the second driver circuit substantially simultaneously drive the first electrode group and the second electrode group.

* * * * *